US008453748B2

(12) United States Patent
Vick, Jr. et al.

(10) Patent No.: US 8,453,748 B2
(45) Date of Patent: Jun. 4, 2013

(54) SUBTERRANEAN WELL VALVE ACTIVATED WITH DIFFERENTIAL PRESSURE

(75) Inventors: James D. Vick, Jr., Dallas, TX (US); Jimmie R. Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 505 days.

(21) Appl. No.: 12/751,407

(22) Filed: Mar. 31, 2010

(65) Prior Publication Data

US 2011/0240299 A1 Oct. 6, 2011

(51) Int. Cl.
*E21B 34/08* (2006.01)

(52) U.S. Cl.
USPC ..... 166/373; 166/321; 166/334.1

(58) Field of Classification Search
USPC ..... 166/373, 375, 319, 321, 323, 324, 166/332.8, 332.7, 334.1
See application file for complete search history.

(56) References Cited

U.S. PATENT DOCUMENTS

| | | | |
|---|---|---|---|
| 3,032,111 | A | 5/1962 | Corely, Jr. et al. |
| 4,073,341 | A | 2/1978 | Parker |
| 4,649,993 | A | 3/1987 | Going, III |
| 4,667,736 | A | 5/1987 | Rumbaugh et al. |
| 4,768,594 | A | 9/1988 | Akkerman |
| 5,465,786 | A | 11/1995 | Akkerman |
| 6,199,629 | B1 | 3/2001 | Shirk et al. |
| 6,253,843 | B1 | 7/2001 | Rawson et al. |
| 6,302,210 | B1 | 10/2001 | Crow et al. |
| 6,478,090 | B2 | 11/2002 | Deaton |
| 6,619,388 | B2 | 9/2003 | Dietz et al. |
| 6,719,057 | B2 | 4/2004 | Johansen |
| 6,820,702 | B2 | 11/2004 | Niedermayr et al. |
| 6,926,089 | B2 | 8/2005 | Goodson, Jr. et al. |
| 6,988,556 | B2 | 1/2006 | Vick, Jr. |
| 7,108,073 | B2 | 9/2006 | Patel |
| 7,114,697 | B2 | 10/2006 | Millet et al. |
| 7,231,971 | B2 | 6/2007 | McCalvin |
| 7,360,600 | B2 | 4/2008 | MacDougall et al. |
| 7,428,922 | B2 | 9/2008 | Fripp et al. |
| 2006/0162932 | A1 | 7/2006 | McCalvin |

(Continued)

FOREIGN PATENT DOCUMENTS

| | | | |
|---|---|---|---|
| EP | 2022933 | A2 | 2/2009 |
| WO | 2007026072 | A1 | 3/2007 |
| WO | 2007149795 | A2 | 12/2007 |

OTHER PUBLICATIONS

Halliburton; DepthStar® Tubing Retrievable Safety Valve, H06191 product brochure; May 2008, 4 pages.

(Continued)

*Primary Examiner* — David Andrews
(74) *Attorney, Agent, or Firm* — Smith IP Services, P.C.

(57) ABSTRACT

A method of actuating a valve in a well can include storing energy as a result of a differential pressure across a closed closure device of the valve, and releasing at least a portion of the stored energy while opening the closure device. A valve for use in a well can include a closure device, a biasing device, and an actuator which stores energy in the biasing device in response to a pressure differential across the closure device. A well system can include a tubular string, and a valve which controls fluid flow through the tubular string. The valve may include a closure device and an actuator which actuates the valve at least partially in response to a pressure differential across the closure device.

16 Claims, 12 Drawing Sheets

U.S. PATENT DOCUMENTS

| | | | |
|---|---|---|---|
| 2008/0053662 | A1 | 3/2008 | Williamson et al. |
| 2008/0135235 | A1 | 6/2008 | McCalvin |
| 2009/0090499 | A1 | 4/2009 | Lewis |

OTHER PUBLICATIONS

Halliburton; SP™ Series Tubing-Retrievable Safety Valve Presentation; Jul. 2008, 27 pages.

Halliburton, Karen Bybee; Improving Well Safety With an Innovative Surface-Controlled Subsurface Safety Valve, Journal of Petroleum Technology; Jan. 2009, 3 pages.

International Search Report with Written Opinion issued Sep. 26, 2011 for International Patent Application No. PCT/US2011/028249, 9 pages.

International Preliminary Report on Patentability issued Oct. 11, 2012 for US PCT Patent Application No. PCT/US2011/028249, 6 pages.

SUBTERRANEAN WELL VALVE ACTIVATED WITH DIFFERENTIAL PRESSURE

BACKGROUND

This disclosure relates generally to equipment utilized and operations performed in conjunction with a subterranean well and, in an example described below, more particularly provides a subterranean well valve activated with differential pressure.

It is beneficial to be able to reduce the power required to actuate well tools downhole. It is also beneficial to be able to reduce the number of components, particularly power consuming components and mechanical elements, in valve actuators.

However, typical valve actuators have high power requirements and many components. Therefore, it will be appreciated that improvements are needed in the art of downhole valve construction.

SUMMARY

In the disclosure below, a valve and associated methods are provided which bring improvements to the art of actuating valves in subterranean wells. One example is described below in which an actuator of the valve has low power requirements and few electrical and/or mechanical components. Another example is described below in which the valve actuation is partially or completely autonomous.

In one aspect, a method of actuating a valve in a subterranean well is provided. The method can include storing energy as a result of a differential pressure across a closed closure device of the valve, and releasing at least a portion of the stored energy while opening the closure device.

In another aspect, a valve for use in a subterranean well is provided. The valve can include a closure device, a biasing device and an actuator which stores energy in the biasing device in response to a pressure differential across the closure device.

In yet another aspect, a well system provided by the disclosure below can include a tubular string and a valve which controls fluid flow through the tubular string. The valve can include a closure device and an actuator which actuates the valve at least partially in response to a pressure differential across the closure device.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
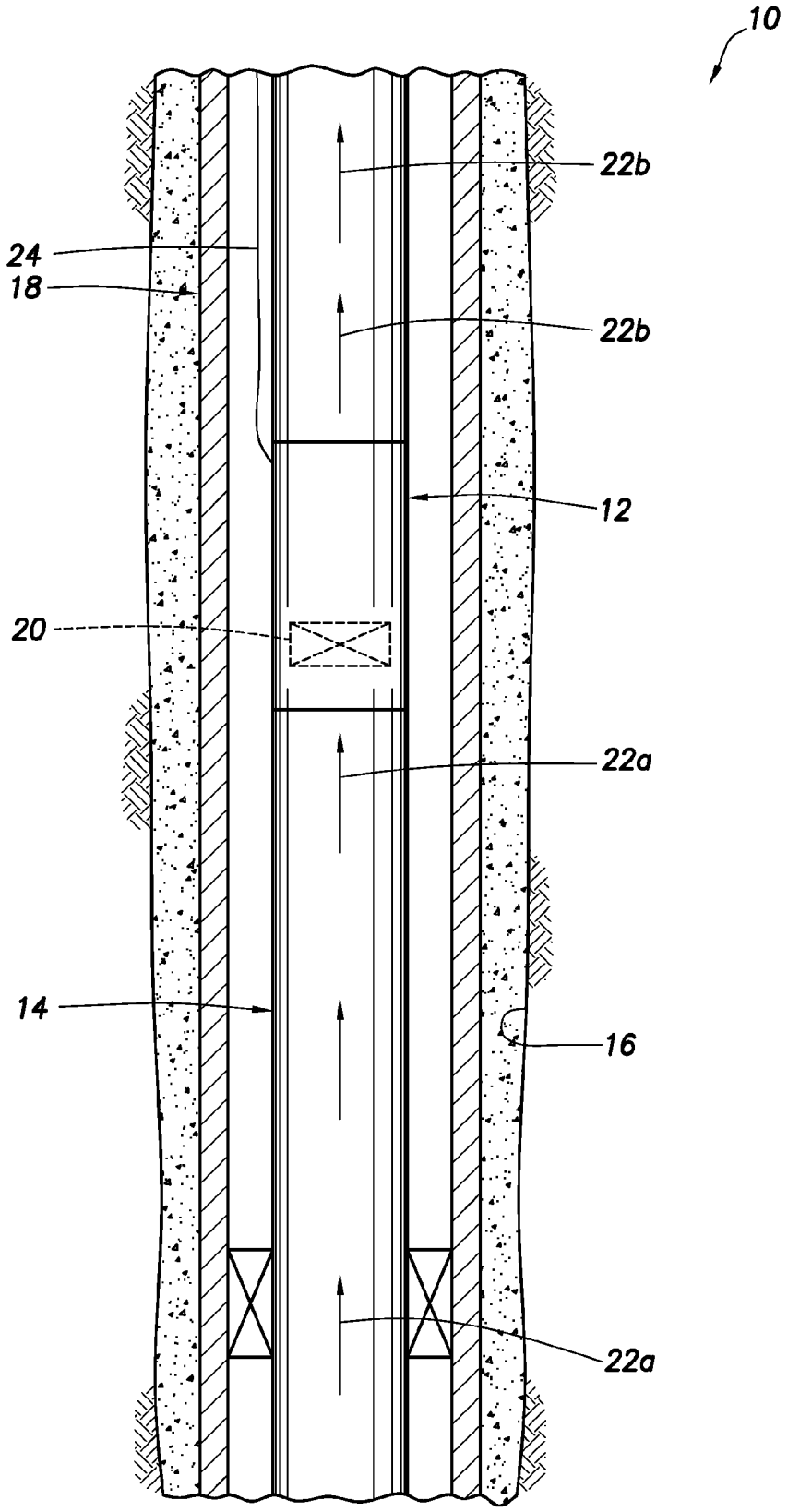
FIG. 1 is a schematic partially cross-sectional view of a well system and associated method which can embody principles of the present disclosure.

Representatively illustrated in FIG. 1 is a well system 10 and associated method which embody principles of this disclosure. In the well system 10, a valve 12 is interconnected in a tubular string 14 disposed in a wellbore 16. A casing string 18 lines the wellbore 16 in this example, but in other examples the wellbore may be uncased proximate the valve 12.

The valve 12 includes a closure assembly 20, which is used to control flow through the tubular string 14. In examples described below, the closure assembly 20 can selectively permit and prevent flow longitudinally through the tubular string 14, but in other examples the closure assembly could control flow through a sidewall of the tubular string, between an interior and exterior of the tubular string, etc.

When the closure assembly 20 is closed, a pressure differential can be created across the closure assembly. As depicted in FIG. 1, pressure of fluid 22*a* below the closure assembly 20 may be greater than pressure of fluid 22*b* above the closure assembly, when the closure assembly is closed. In other examples, pressure of the fluid 22*b* above the closure assembly 20 may be greater than pressure of fluid 22*a* below the closure assembly, either pressure may be greater than the other, or the pressures may be equalized, when the closure assembly is closed.

The valve 12 depicted in FIG. 1 is representatively a safety valve, in that it is used to prevent an unintended loss of fluid from the well in the event of an emergency. As an example, a safety valve can prevent a blowout by preventing uncontrolled flow of fluid through the tubular string 14.

However, it should be clearly understood that a safety valve is only one type of valve which can incorporate the principles of this disclosure. Examples of other types of valves which can utilize the principles of this disclosure are described below, but the principles of this disclosure are not in any manner limited to any details of the particular valves described herein, since any type of valve may be used in keeping with the principles of this disclosure.

One or more lines 24 are representatively illustrated in FIG. 1 as being connected to the valve 12 for operation thereof. The lines 24 could be hydraulic, electrical, optical or any other type or combination of lines, and the lines may be used for transmitting signals (such as, command or data signals), for supplying power to the valve 12, or for any other purpose. However, in other examples described below, the lines 24 are not used.

Referring additionally now to FIGS. 2A-4E, an example of the valve 12 is schematically and representatively illustrated in enlarged scale cross-sectional views of successive axial sections of the valve. The valve 12 may be used in the well system 10 of FIG. 1, or the valve may be used in any other well system. The valve 12 is depicted in a closed configuration in FIGS. 2A-E, in an energy storing configuration in FIGS. 3A-E, and in an open configuration in FIGS. 4A-E.

Figure 2A:
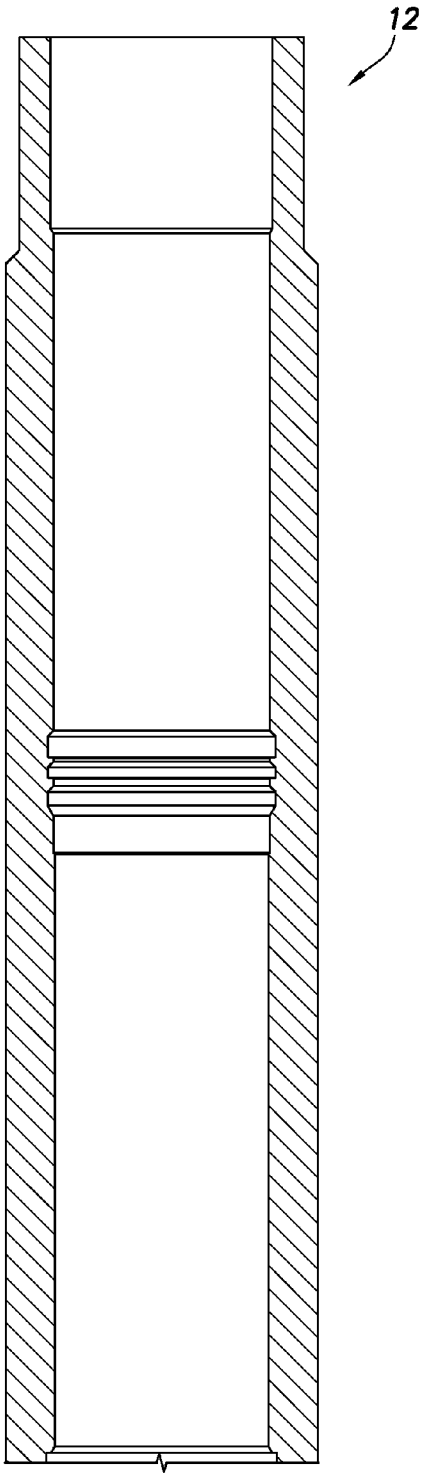
FIGS. 2A-E are enlarged scale cross-sectional views of successive axial portions of a valve which may be used in the well system and method of FIG. 1, the valve being in a closed configuration.
Figure 2B:
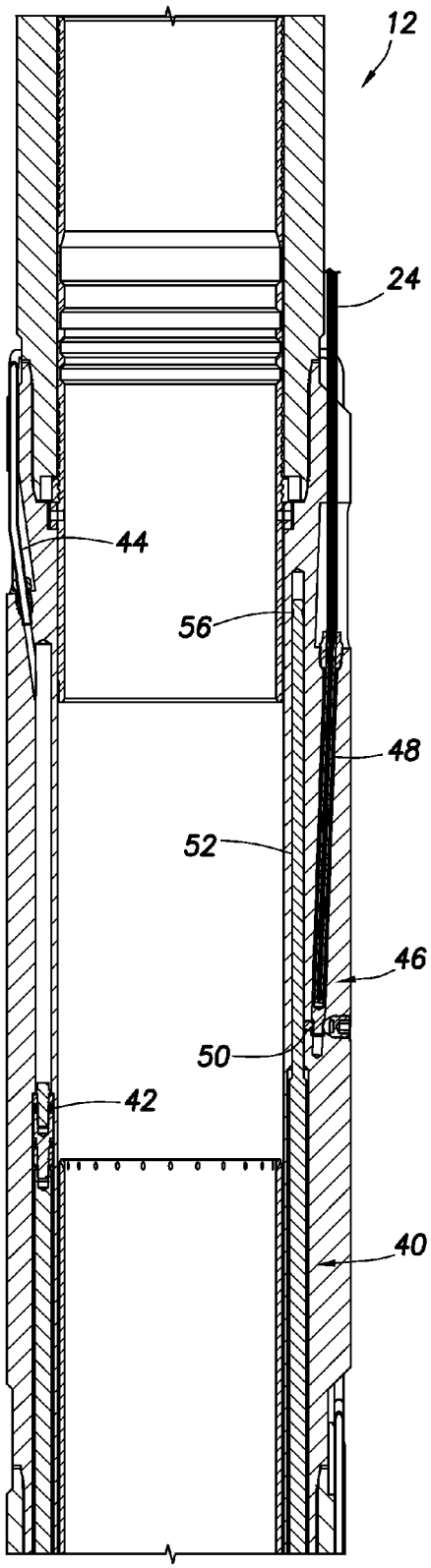
Figure 2C:
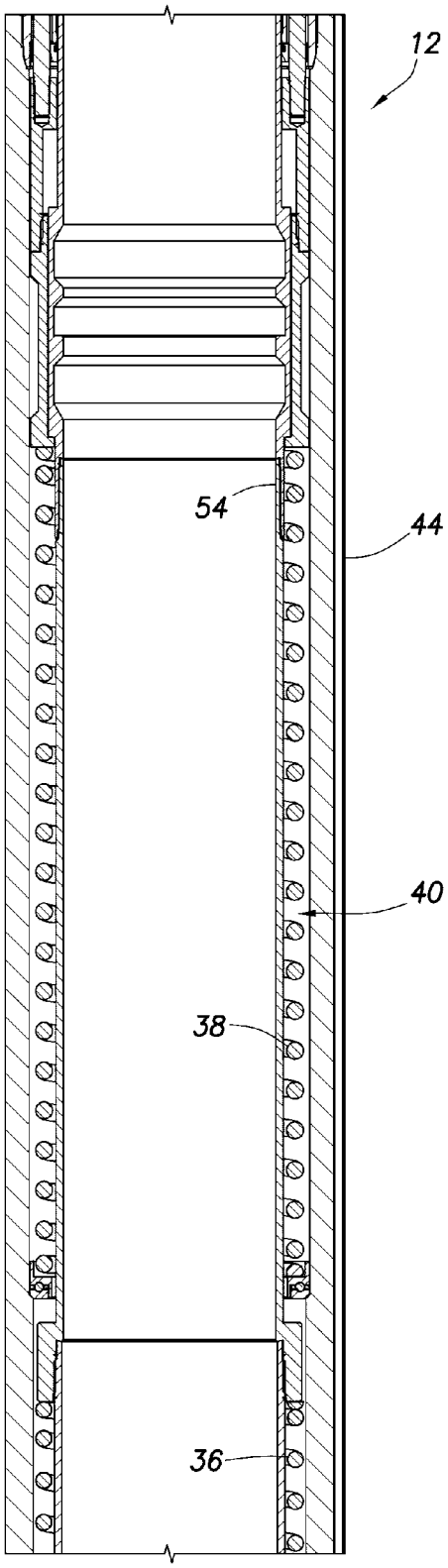
Figure 2D:
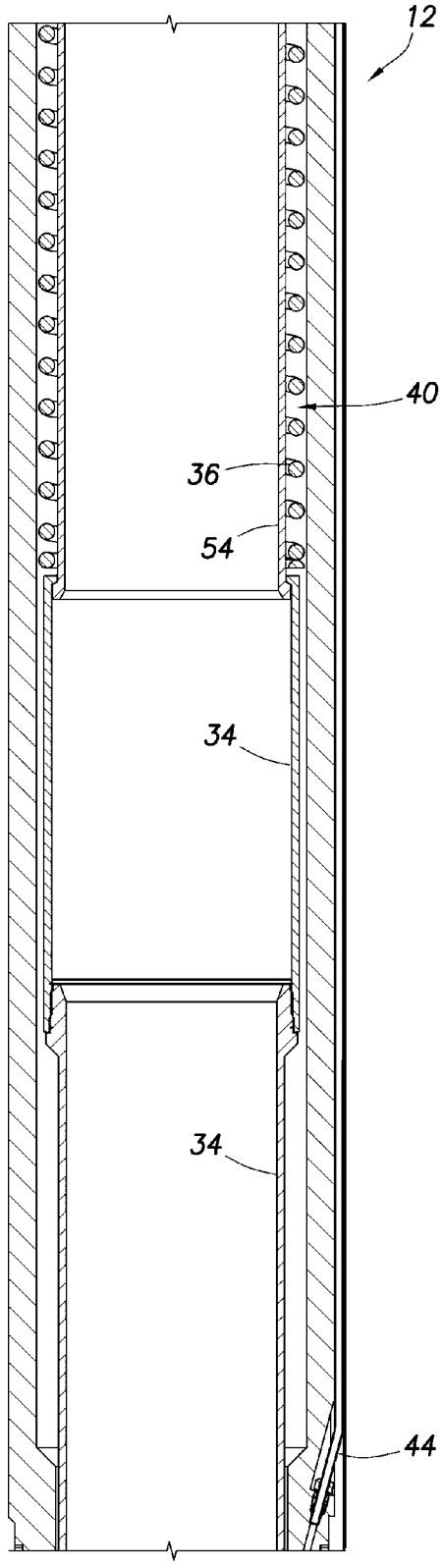
Figure 2E:
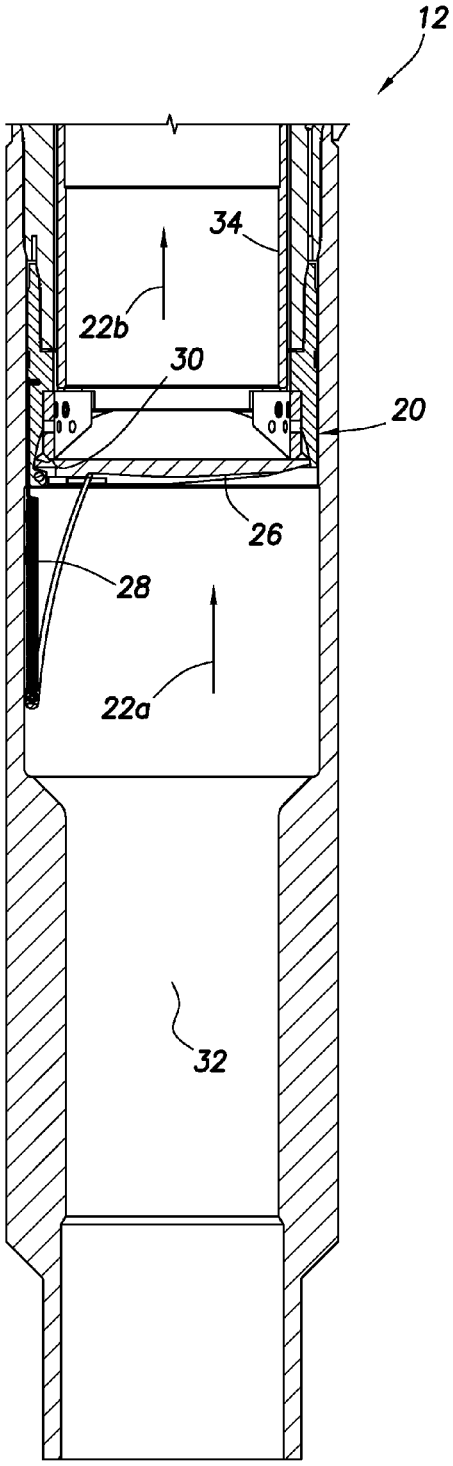
Figure 3A:
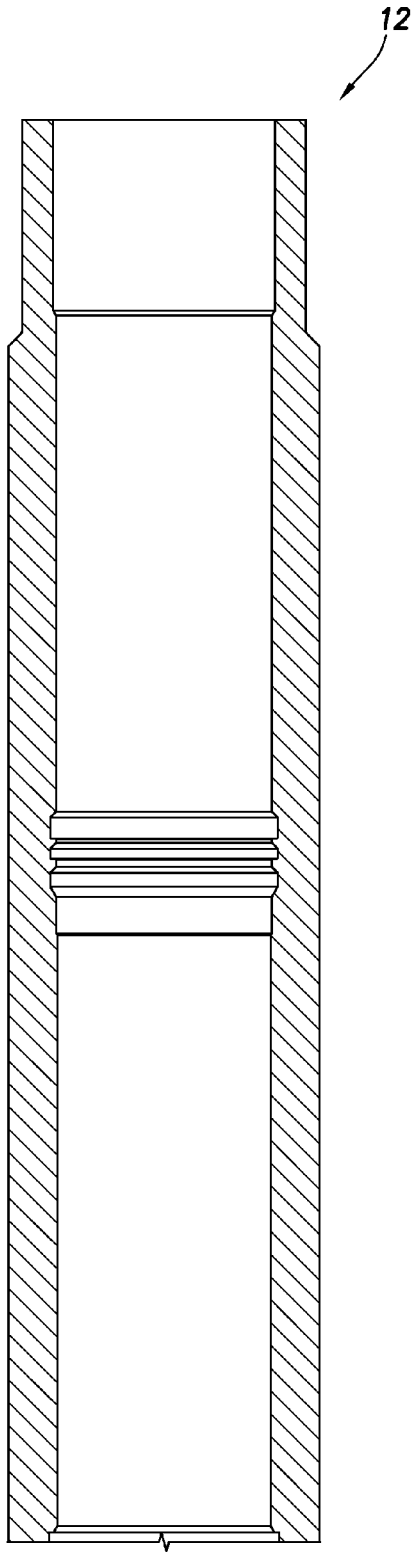
FIGS. 3A-E are enlarged scale cross-sectional views of successive axial portions of the valve in an energy storing closed configuration.
Figure 3B:
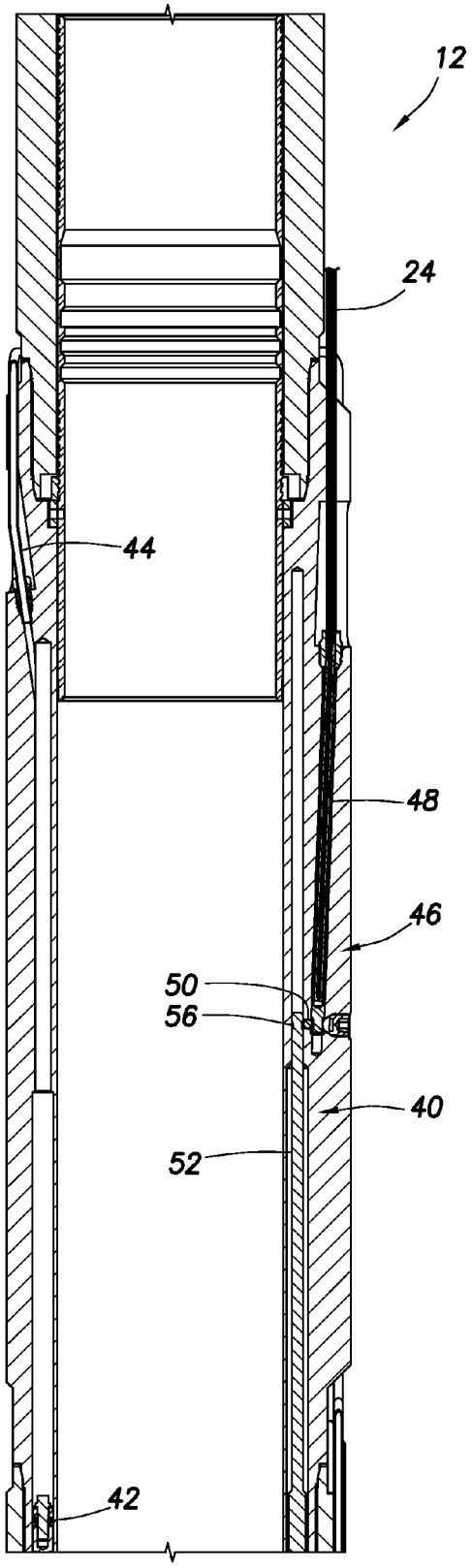
Figure 3C:
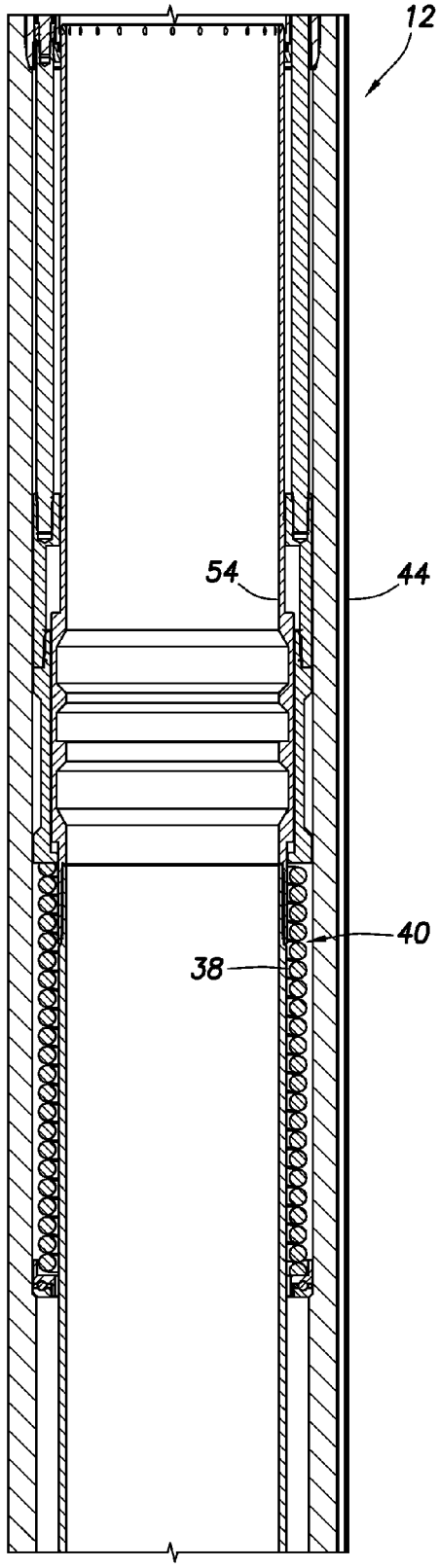
Figure 3D:
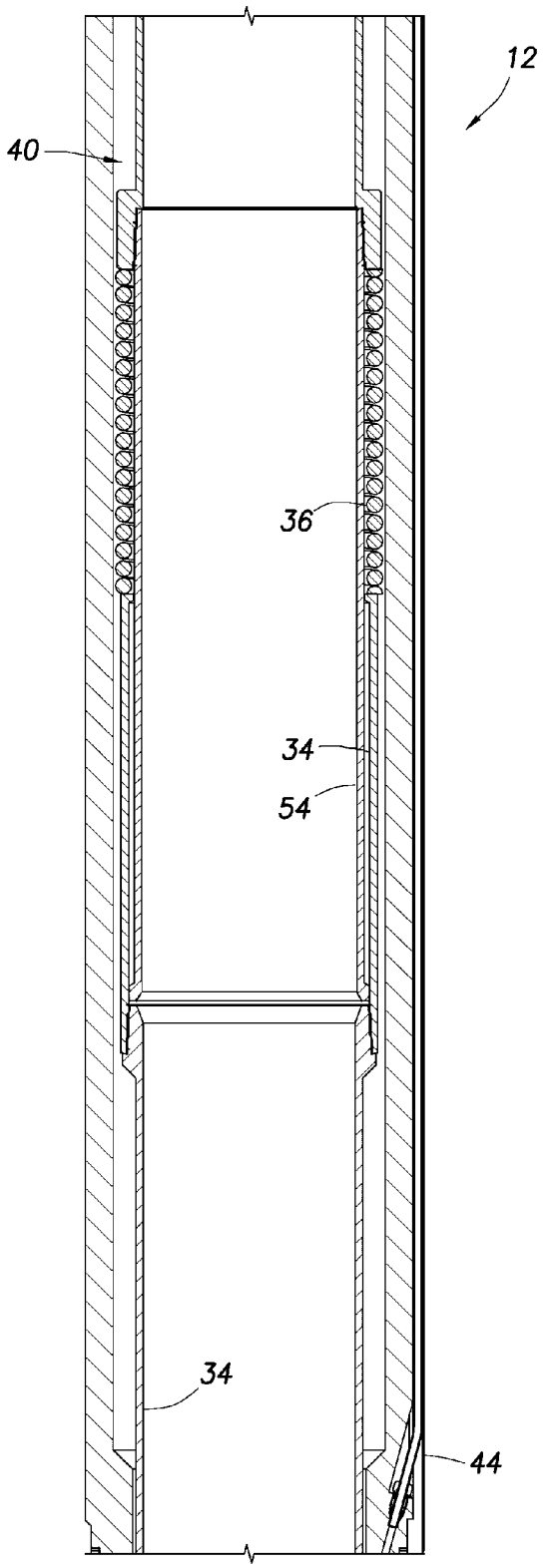
Figure 3E:
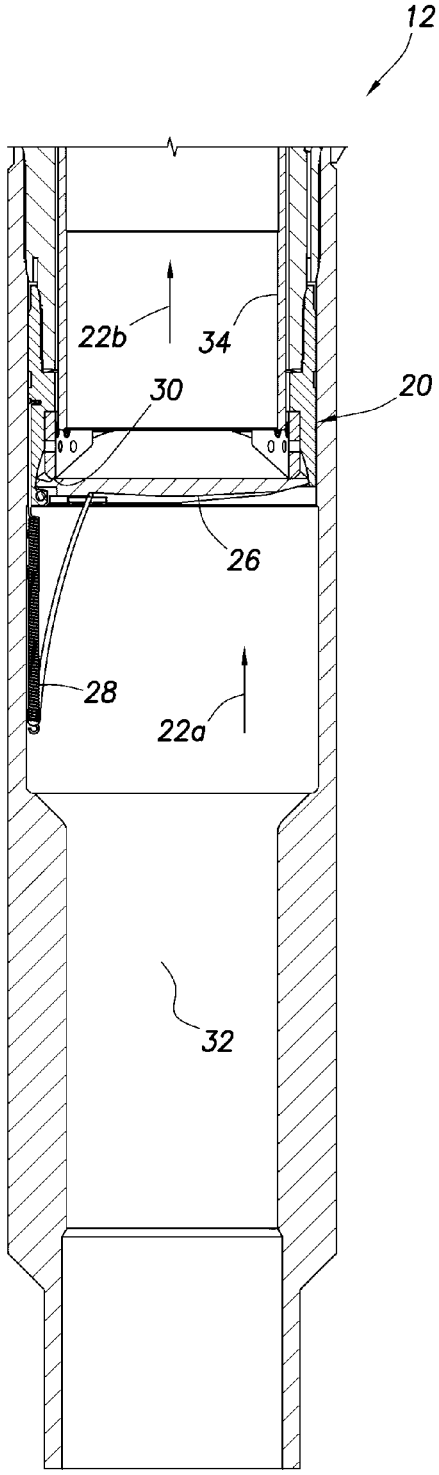
Figure 4A:
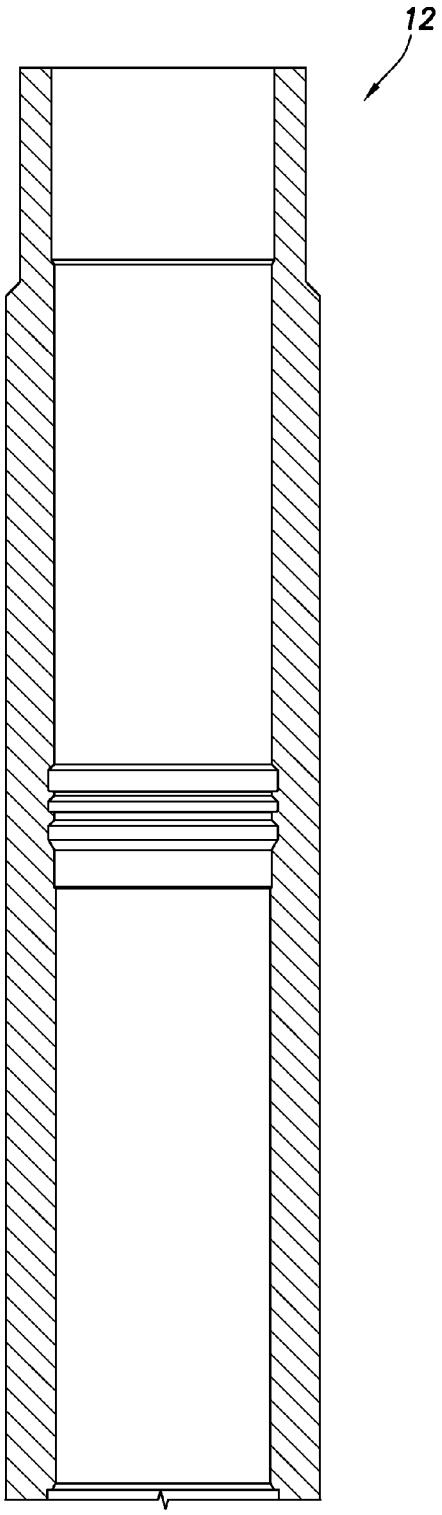
FIGS. 4A-E are enlarged scale cross-sectional views of successive axial portions of the valve in an open configuration.
Figure 4B:
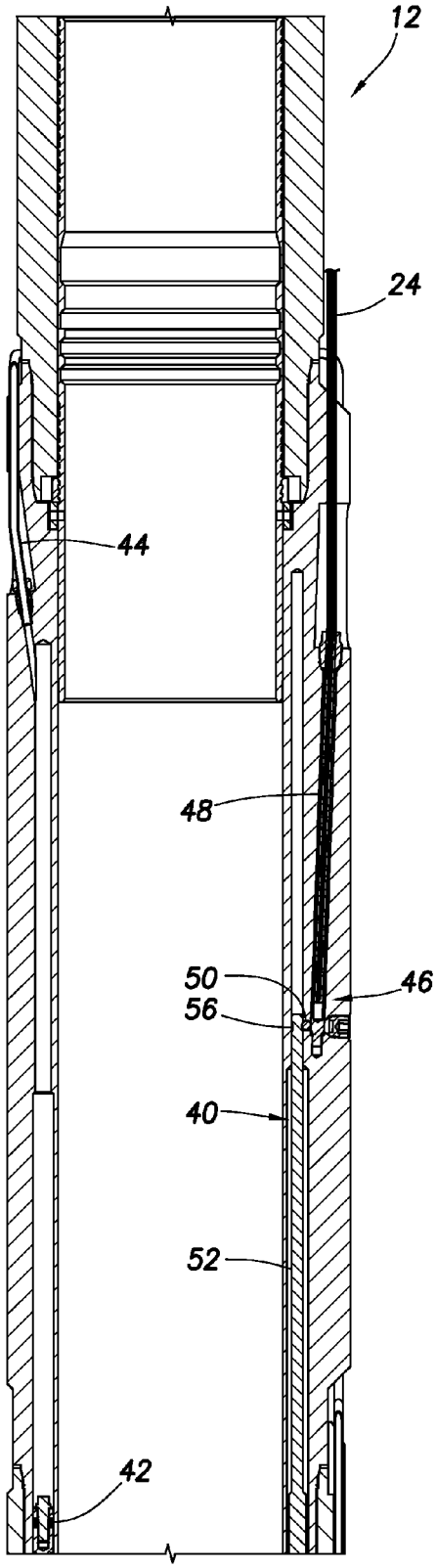
Figure 4C:
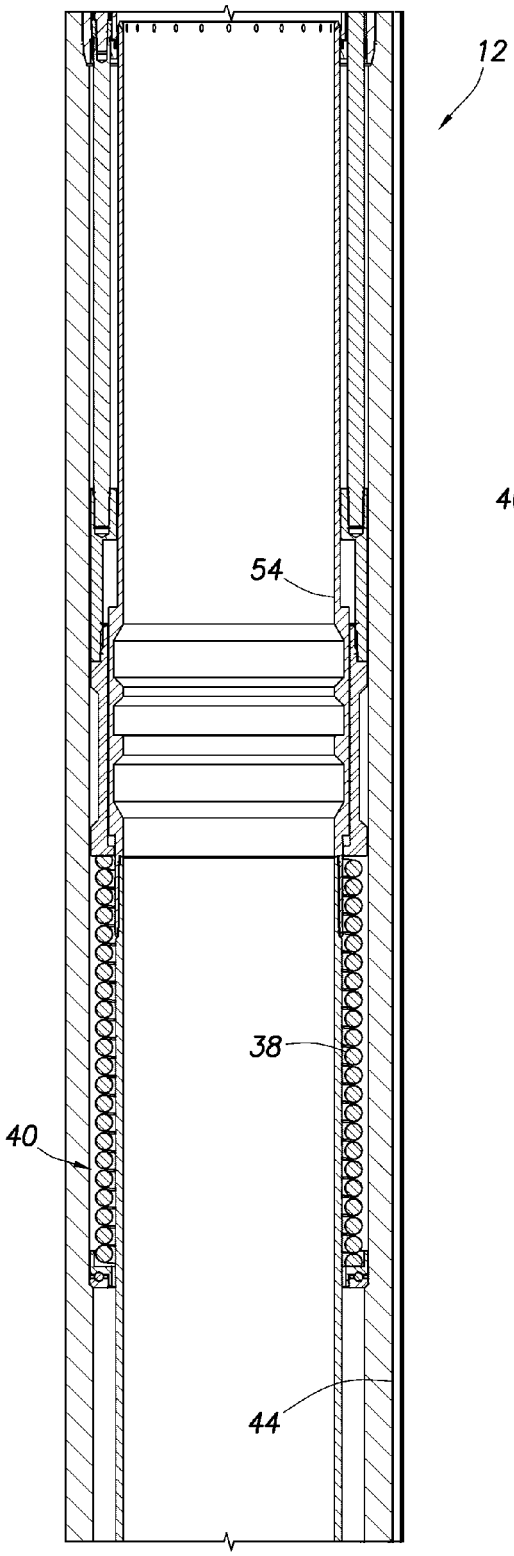
Figure 4D:
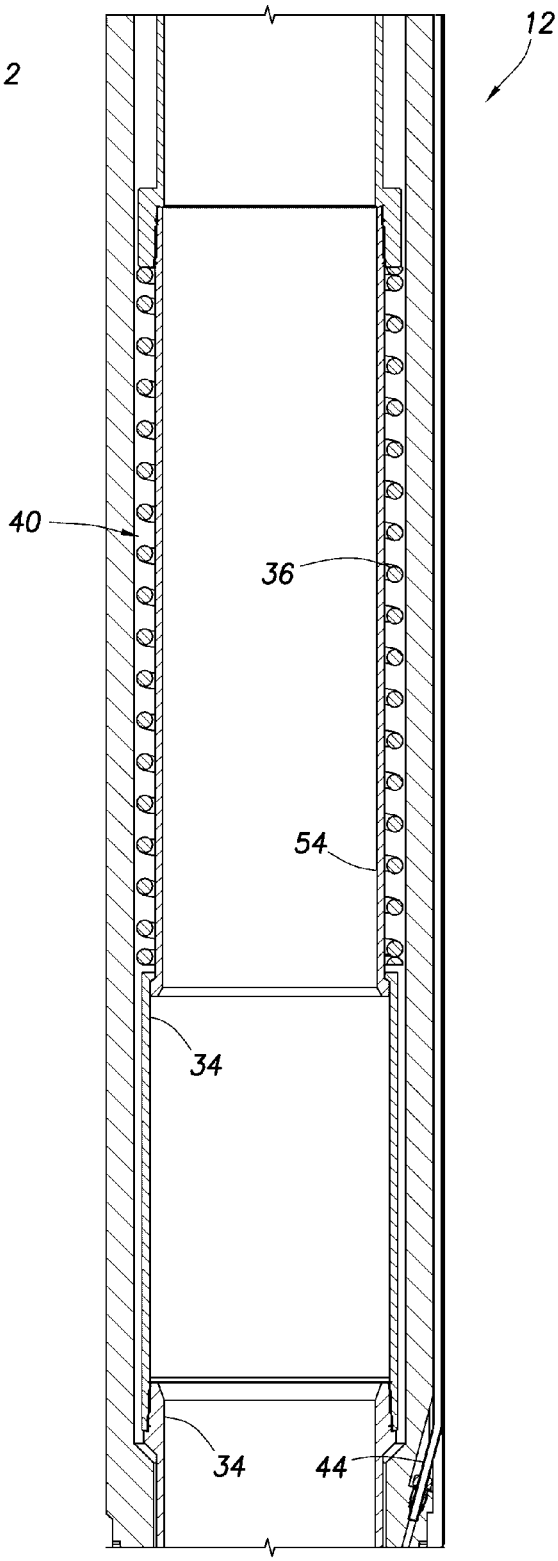
Figure 4E:
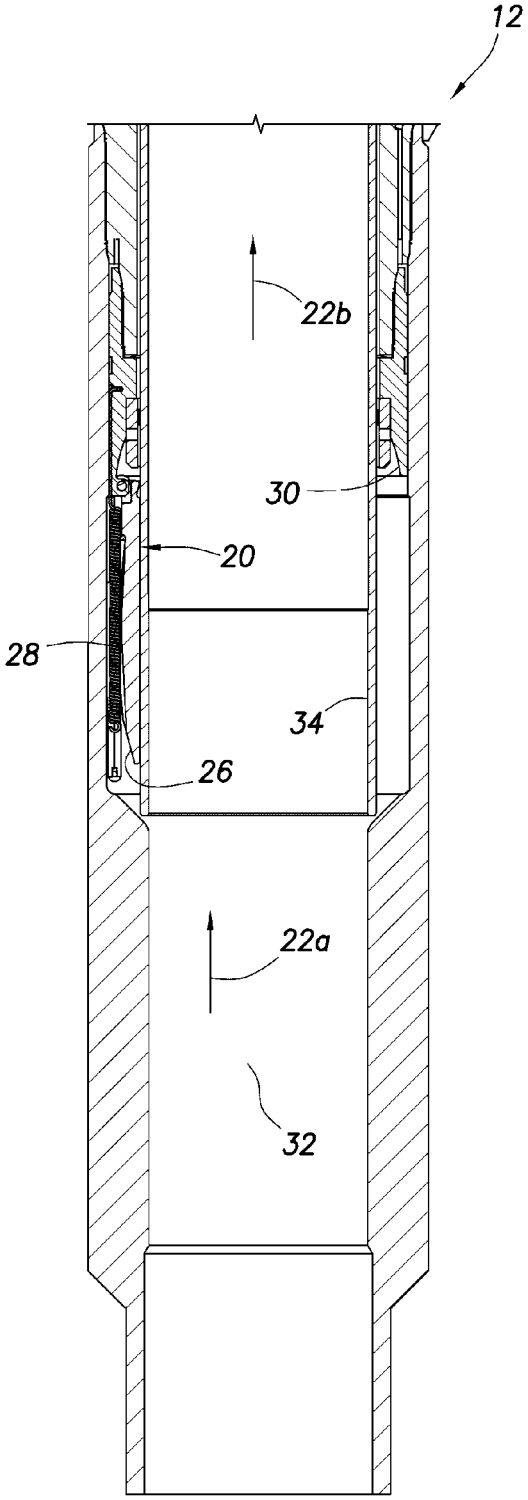

The closure assembly 20 is illustrated in FIGS. 2E, 3E & 4E. In these views it may be seen that the closure assembly 20 includes a closure device 26 (in this example, a flapper), a spring 28 which biases the closure device toward its closed position, and a seat 30 which sealingly engages the closure device (thereby preventing flow through an internal longitudinal flow passage 32) when the closure device is in its closed position.

In the open configuration of FIGS. 4A-E, a tubular member 34 (sometimes referred to as a "nose" in the safety valve art) maintains the closure device 26 in its open position. The member 34 must be displaced upward to its position as depicted in FIGS. 2A-3E in order to allow the closure device 26 to pivot upward to its closed position.

In the closed configuration of FIGS. 2A-E, a pressure differential across the closure device 26 can be created by pressure in the fluid 22*a* below the closure device being greater than pressure in the fluid 22*b* above the closure device. In the open configuration of FIGS. 4A-E, pressure in the fluids 22*a,b* is substantially equalized.

The valve 12 uniquely takes advantage of the pressure differential across the closure device 26 in its closed position, in order to store energy in biasing devices 36, 38 included in an actuator 40 of the valve. The stored energy in the biasing devices 36, 38 can be used to displace the member 34 downward to its position depicted in FIG. 4E, thereby opening (or at least maintaining open) the closure device 26.

The biasing devices 36, 38 are depicted in FIGS. 2A-4E as being spiral wound compression springs. However, in other examples, the biasing devices 36, 38 (or either of them) may comprise another type of spring (such as an extension spring), a compressed gas, a compressible liquid or any other type of biasing device.

In FIGS. 2A-E, the closure device 26 has just closed, or a pressure differential is not otherwise created across the closure device. However, in FIGS. 3A-E, a pressure differential across the closure device 26 has been created, and this pressure differential has caused a piston 42 of the actuator 40 to displace downward (see FIG. 3B), thereby compressing the biasing devices 36, 38 (compare the biasing devices as depicted in FIGS. 2C & D with the biasing devices as depicted in FIGS. 3C & D).

The energy stored in the biasing devices 36, 38 increases the biasing forces exerted by the biasing devices, in response to the increased pressure differential across the closure device 26. Thus, preferably the pressure differential across the closure device 26 is increased to a predetermined level in the configuration of FIGS. 3A-E, in order to store a desired minimum level of energy in the biasing devices 36, 38, prior to opening the valve 12.

The piston 42 is exposed on its upper side to pressure in the fluid 22*a* below the closure device 26 via a line 44. Although the line 44 is depicted as being routed external to the valve 12, the line could be otherwise positioned without departing from the principles of this disclosure.

The piston 42 is exposed on its lower side to pressure in the fluid 22*b* above the closure device 26. In this manner, the pressure differential across the closure device 26 is also applied across the piston 42. In other examples described below, the same pressure differential across the closure device 26 is not necessarily also applied across the piston 42.

A releasing device 46 of the actuator 40 includes an electrical solenoid 48, a dog 50 and a detent rod 52. The rod 52 is connected to a tubular opening prong assembly 54, which is biased upward by the biasing device 38. The piston 42 is also connected to the opening prong assembly 54.

When the piston 42 is in its lower position (as depicted in FIGS. 3B & 4B), the solenoid 48 can be energized to bias the dog 50 into engagement with a recess 56 on the detent rod 52. In this manner, the opening prong assembly 54 can be maintained in its downward position, even when there is no pressure differential across the closure device 26.

Thus, in FIGS. 4A-E, the opening prong assembly 54 is in its downward position, and the member 34 maintains the closure device 26 in its open position, even though a pressure differential does not exist across the closure device to bias the piston 42 downward. When it is desired to close the valve 12, the solenoid 48 can be de-energized, thereby releasing the dog 50 from the recess 56, and the biasing device 38 will displace the opening prong assembly 54 upward, along with the member 34, thereby allowing the closure device 26 to pivot to its closed position, as depicted in FIGS. 2A-E.

In FIG. 4B, the lines 24 are shown as being connected to the solenoid 48 for supplying electrical power to operate the solenoid. It should be clearly understood, however, that this is only one example of a wide variety of ways in which a releasing device can be operated in the valve 12. In other examples, power for operating the releasing device 46 may be supplied downhole (such as, by a downhole generator, by batteries, etc.), instead of being supplied from a remote location. In still further examples, other forms of power (such as mechanical, optical, hydraulic, etc.) may be used, instead of (or in addition to) electrical power.

Beginning with the configuration of FIGS. 2A-E, a method of operating the valve 12 can proceed as follows:

1) With the closure device 26 in its closed position, and no pressure differential across the closure device, the piston 42 is in its uppermost position and does not apply any force to the biasing devices 36, 38.

2) A pressure differential across the closure device 26 increases, thereby causing the piston 42 to displace downward and apply increased force to the biasing devices 36, 38 as depicted in FIGS. 3A-E. The pressure differential may result from preexisting conditions in the well (such as, a naturally pressurized producing formation, etc.), or the pressure differential may be induced (for example, by releasing pressure from the fluid 22*a* above the closure device 26, introducing a lighter fluid into the passage 32 above the closure device, etc.).

3) The pressure differential is increased to a predetermined minimum level, thereby storing a desired minimum amount of energy in the biasing devices 36, 38.

4) The releasing device 46 is energized, thereby maintaining the stored energy in the biasing devices 36, 38.

5) When it is desired to open the valve 12, the pressure differential is decreased, thereby allowing the closure device 26 to pivot to its open position as depicted in FIGS. 4A-E, and allowing the stored energy in at least the biasing device 36 to displace the member 34 downward to maintain the closure device in its open position. Pressure may be applied to the flow passage above the closure device 26 to equalize the pressure differential. Preferably, when the pressure differential across the closure device 26 is fully equalized, the stored energy in the biasing device 36 will displace the member 34 downward to pivot the closure device to the open position.

6) When it is desired to close the valve 12, the releasing device 46 is de-energized, thereby allowing the biasing device 38 to displace the piston 42 upward to its position as depicted in FIGS. 2A-E. The member 34 no longer maintains the closure device 26 in its open position, and the closure device pivots to its closed position.

Note that step 6 above can be performed intentionally (for example, when periodically testing the valve 12), or the step can be performed unintentionally (for example, when an emergency situation occurs, the lines 24 are severed, etc.). The fail-safe operation of the valve 12 is to its closed configuration, and this happens at any time the releasing device 46 is de-energized.

Thus, interruption of the electrical signal transmitted via the lines 24 is used to cause the valve 12 to actuate to its fail-safe closed configuration. However, this is just one example of a way in which an interrupted signal can be used to actuate a releasing device. In other examples, the interrupted signal could be an acoustic, mechanical, pressure, optical, hydraulic, electromagnetic or other type of signal, and the signal could be transmitted via various forms of telemetry, and the signal could be sensed by a sensor of the valve 12.

Figure 5A:
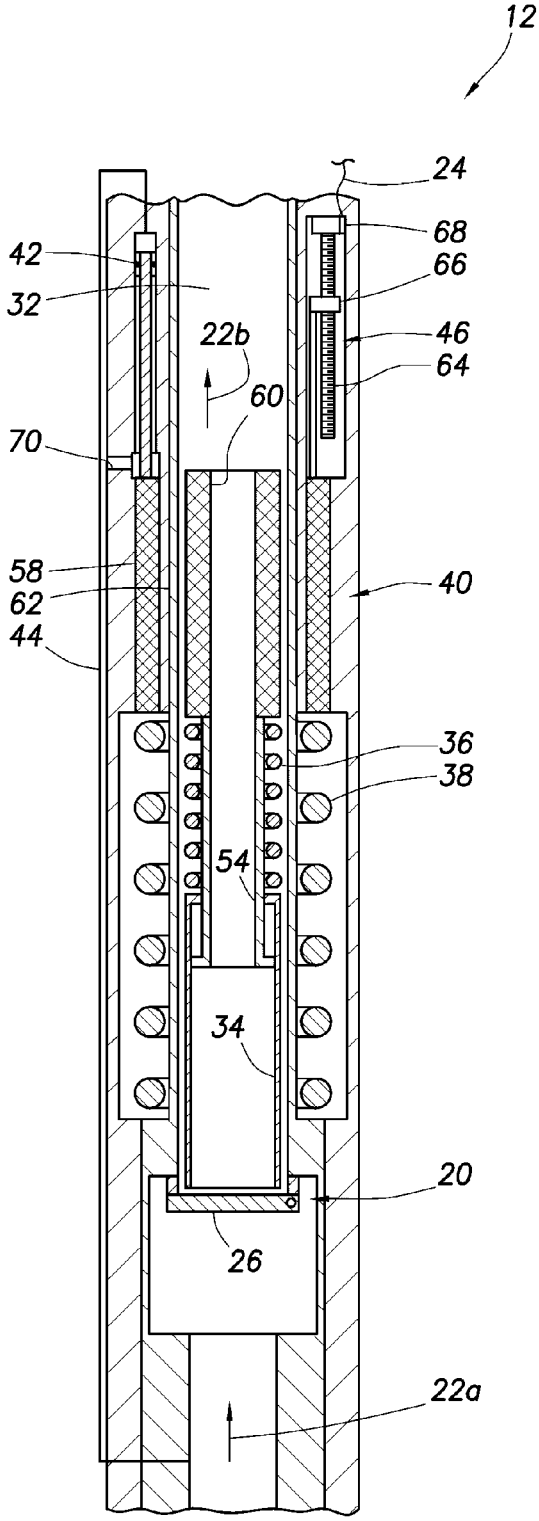
FIGS. 5A-C are schematic cross-sectional views of another configuration of the valve.
Figure 5B:
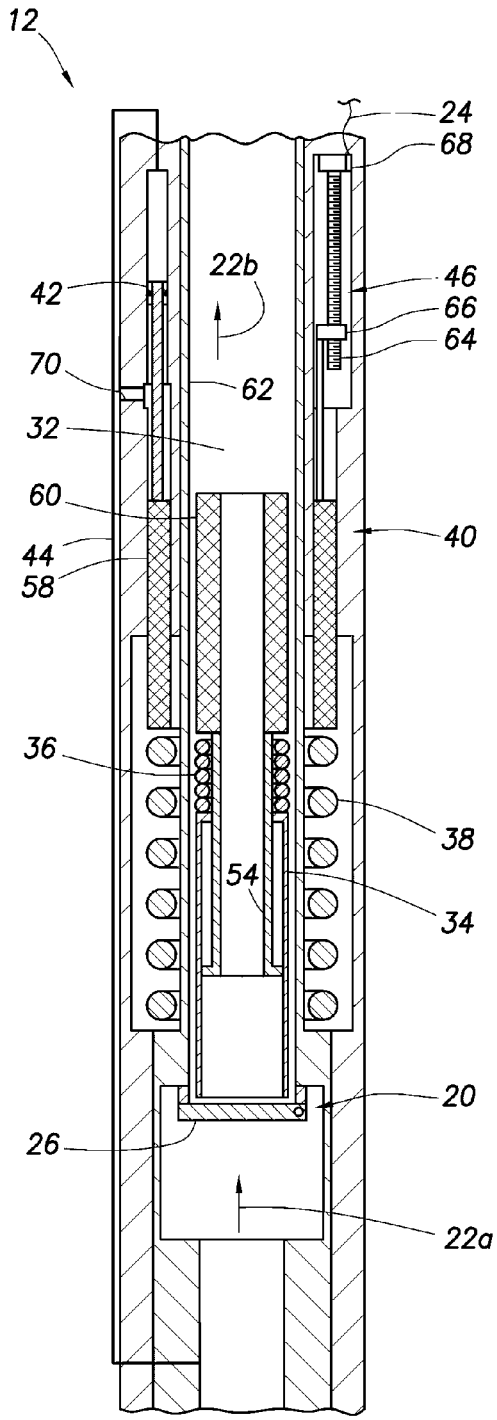
Figure 5C:
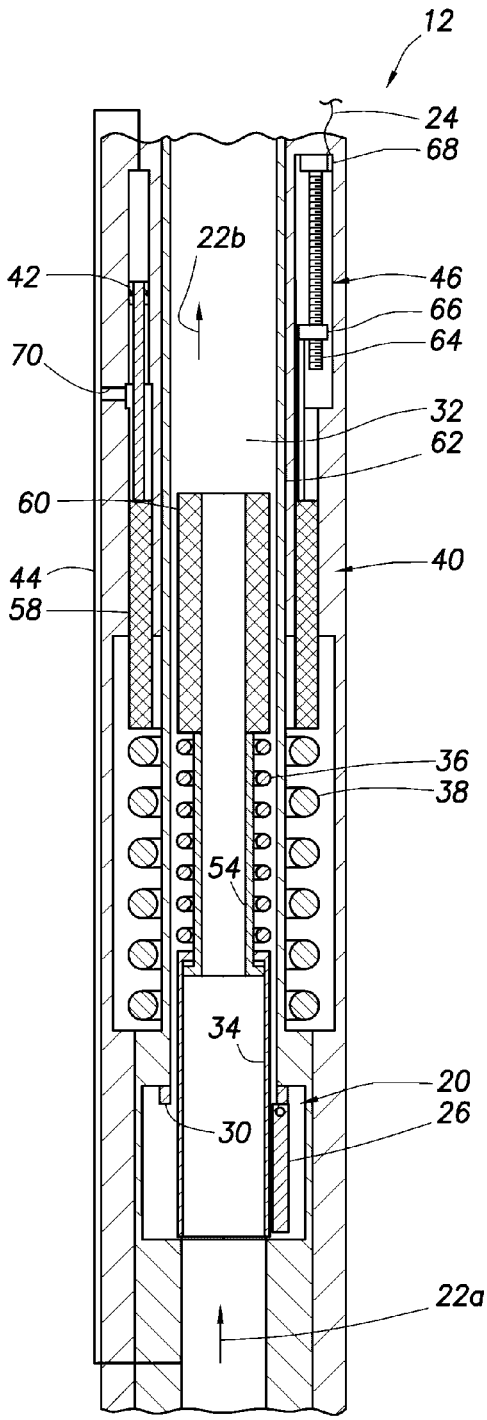

Referring additionally now to FIGS. 5A-C, another configuration of the valve 12 is representatively and schematically illustrated. The valve 12 is depicted in a closed configuration in FIG. 5A, the valve is depicted in an energy storing configuration in FIG. 5B, and the valve is depicted in an open configuration in FIG. 5C. The valve 12 may be used in the system 10 described above, or in any other well system.

The valve 12 of FIGS. 5A-C is similar in many respects to the valve of FIGS. 2A-4E. However, the valve 12 of FIGS. 5A-C differs substantially in the configuration of its releasing device 46 and actuator 40.

The actuator 40 of FIGS. 5A-C includes an annular magnet assembly 58 connected to the piston 42 and releasing device 46. Another annular magnet assembly 60 is magnetically coupled to the magnet assembly 58. Thus, the magnet assemblies 58, 60 displace upwardly and downwardly together, on opposite sides of a pressure isolating wall 62.

Preferably, each of the magnet assemblies 58, 60 is made up of a stack of annular shaped magnets. In this manner, the actuator 40 may be similar to that described in U.S. Pat. No. 6,988,556, the entire disclosure of which is incorporated herein by this reference.

The biasing device 36 biases the member 34 downward relative to the magnet assembly 60. The biasing device 38 biases the magnetic assembly 58 upward.

The releasing device 46 of FIGS. 5A-C includes an externally threaded member 64, an internally threaded nut 66 and an electrically actuated brake 68. The nut 66 is connected to the magnet assembly 58 so that, as the magnet assembly displaces upward or downward, the nut also displaces upward or downward relative to the threaded member 64, thereby causing the threaded member to rotate.

When electrically energized, the brake 68 can prevent rotation of the threaded member 64, and thereby can prevent displacement of the nut 66 and the connected magnet assembly 58. When the brake 68 is de-energized, the magnet assembly 58 can displace upwardly or downwardly as biased by the piston 42 and/or the biasing device 38.

Operation of the valve 12 as depicted in FIGS. 5A-C is very similar to operation of the valve of FIGS. 2A-4E. In the closed configuration of FIG. 5A, a pressure differential can be created across the closure device 26.

In the energy storing configuration of FIG. 5B, the pressure differential across the closure device 26 causes the piston 42 to displace downwardly, thereby storing energy in the biasing devices 36, 38. The releasing device 46 is energized when a predetermined pressure differential level is reached, thereby storing a minimum desired amount of energy in the biasing devices 36, 38.

In the open configuration of FIG. 5C, the pressure differential across the closure device 26 has been reduced, and the biasing device 36 has displaced the member 34 downwardly to maintain the closure device 26 in its open position. The releasing device 46 can then be de-energized to close the valve 12, as depicted in FIG. 5A.

As with the configuration of FIGS. 2A-4E, many different modifications may be made to the configuration of FIGS. 5A-C, in keeping with the principles of this disclosure. For example: 1) instead of the lines 24 extending to a remote location, power may be supplied locally by batteries, a downhole generator, etc.; 2) the brake 68 could be energized mechanically, hydraulically, optically, etc., instead of (or in addition to) electrically; 3) the signal to maintain the releasing device 46 energized could be transmitted acoustically, mechanically, by pressure, optically, hydraulically, electromagnetically, or by any other means, and the signal could be detected by a sensor of the valve 12.

Note that the valve 12 of FIGS. 5A-C, similar to the valve of FIGS. 2A-4E, is of the type known to those skilled in the art as a safety valve, although the valve could be used for other purposes without departing from the principles of this disclosure. As such, the valve 12 of FIGS. 5A-C preferably is actuated to its fail-safe closed configuration of FIG. 5A whenever there is an interruption in the signal transmitted to the releasing device 46.

Note that another difference between the valve 12 configuration of FIGS. 5A-C and the valve configuration of FIGS. 2A-4E is that the piston 42 in the configuration of FIGS. 5A-C is exposed on its lower side to pressure on the exterior of the valve via a passage 70. Thus, the pressure differential which biases the piston 42 downward is between pressure in the flow passage 32 below the closure device 26, and pressure on the exterior of the valve 12 (e.g., in an annulus formed radially between the tubular string 14 and the casing string 18).

Figure 6:
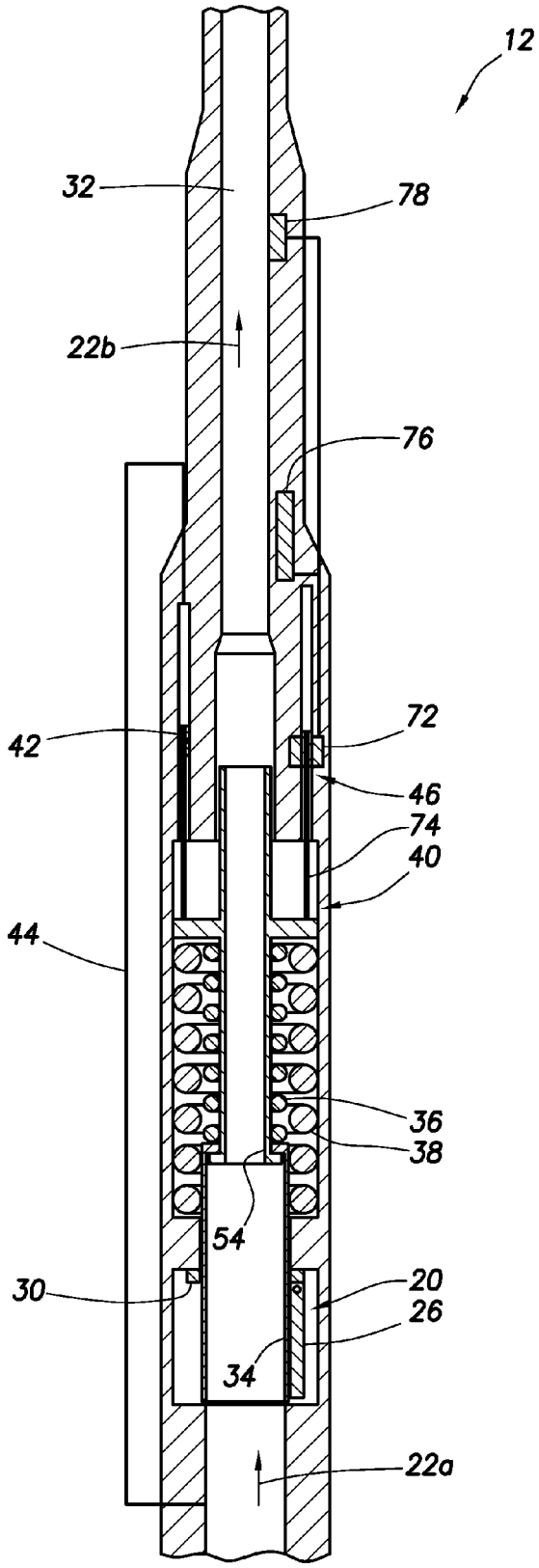
FIG. 6 is a schematic cross-sectional view of yet another configuration of the valve.

Referring additionally now to FIG. 6, another configuration of the valve 12 is representatively and schematically illustrated. The valve 12 may be used in the system 10 described above, or in any other well system.

The valve 12 configuration of FIG. 6 is similar in many respects to the valve of FIGS. 5A-C. However, several differences include: 1) the magnet assemblies 58, 60 and wall 62 are not used; 2) the piston 42 is exposed on its lower side to pressure in the flow passage 32 above the closure device 26 (as in the valve configuration of FIGS. 2A-4E); and 3) another type of releasing device 46 is used.

The releasing device 46 of FIG. 6 includes a solenoid operated gripper 72 which grips a rod 74 when the gripper is electrically energized. This is somewhat similar to the function performed by the solenoid 48 and dog 50 which engage the recess 56 on the detent rod 52 in the configuration of FIGS. 2A-4E.

The rod 74 is connected to the opening prong assembly 54, as is the piston 42. When the piston 42 has displaced the opening prong assembly 54 downwardly, thereby storing energy in the biasing devices 36, 38, the gripper 72 can be energized to grip the rod 74 and prevent upward displacement of the opening prong assembly 54, thereby maintaining the stored energy in the biasing devices.

To close the valve 12, the gripper 72 is de-energized (either intentionally or unintentionally), thereby permitting upward displacement of the opening prong assembly 54 by the biasing device 38, and allowing the closure device 26 to pivot upward to its closed position.

A control system 76 with a sensor 78 is provided in the configuration of FIG. 6 for controlling the operation of the releasing device 46. The control system 76 may include batteries, and/or it may be supplied with power from a downhole generator, or from a remote location, etc. The control system 76 and sensor 78 may be provided as a single integrated unit, as part of the releasing device 46, or any element of the control system and/or sensor may be separately provided in the valve 12.

The sensor 78 detects a signal and provides an indication to the control system 76 as to whether the signal is being detected or has been interrupted. The control system 76 is connected to the gripper 72 for selectively energizing and de-energizing the gripper in response to the indications provided by the sensor 78.

The sensor 78 may, in various examples, detect pressure, mechanical, acoustic, electromagnetic, optical or any other type of signals. In the example of FIG. 6, the sensor 78 is connected to the flow passage 32 to, for example, detect a pressure signal transmitted via the flow passage.

When the signal is interrupted, the sensor 78 indicates this to the control system 76, which de-energizes the gripper 72, thereby allowing the biasing device 38 to displace the opening prong assembly 54 upward. The closure device 26 closes when the member 34 no longer prevents the closure device from pivoting upward to its closed position.

In other examples, the sensor 78 could detect the presence of a structure (such as a tubular string, a well tool, etc.) in the flow passage, and could cause the valve 12 to close when the presence of the structure is no longer detected. In this manner, the valve 12 can be of the type known as a foot valve or isolation valve. The valve 12 can be opened when it is desired to permit the structure to pass downwardly through the flow passage 32, by applying increased pressure to the passage above the closure device (or otherwise decreasing the pressure differential across the closure device).

Note that the sensor 78 and control system 76 may be used with any of the other configurations of the valve 12 described herein. Furthermore, any of the features of any of the described configurations may be used with any of the other configurations of the valve 12 described herein, in keeping with the principles of this disclosure.

Figure 7A:
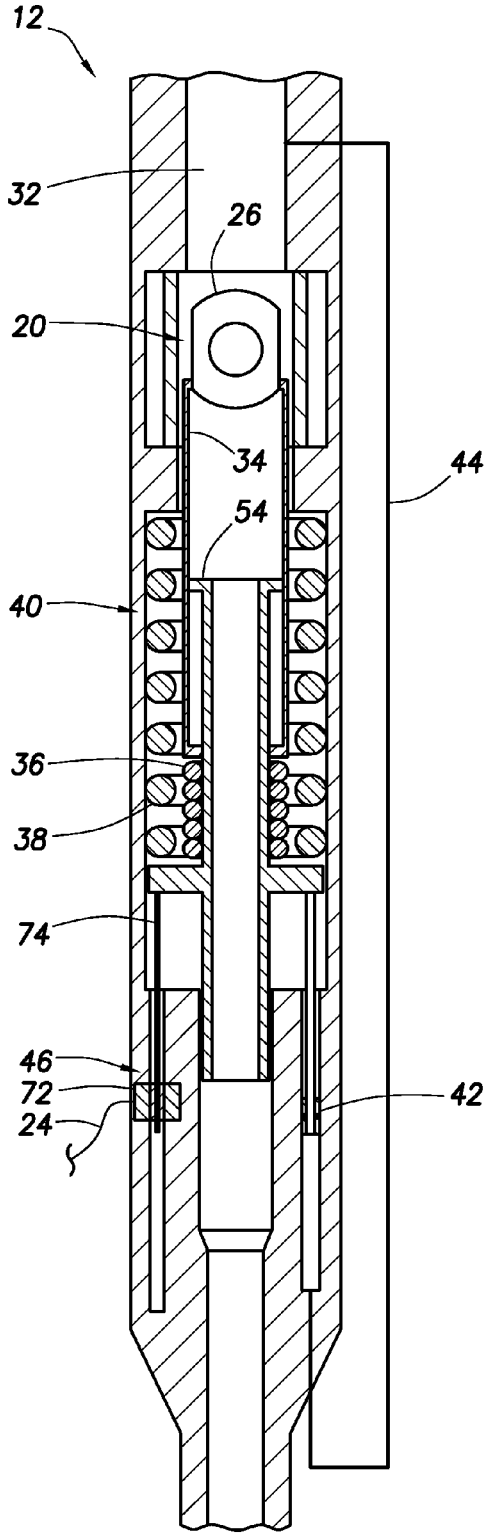
FIGS. 7A & B are schematic cross-sectional views of a further configuration of the valve.

Referring additionally now to FIGS. 7A & B, yet another configuration of the valve 12 is representatively and schematically illustrated. The valve 12 of FIGS. 7A & B may be used in the system 10 described above, or it may be used in any other well system.

One significant difference between the valve 12 of FIGS. 7A & B and the other configurations of the valve described above is that the closure assembly 20 in the configuration of FIGS. 7A & B comprises a ball closure device 26, instead of a flapper-type closure device. However, the valve 12 of FIGS. 7A & B could include a flapper-type closure device 26, and/or the other configurations of the valve described herein could include a ball closure device, in keeping with the principles of this disclosure.

Figure 7B:
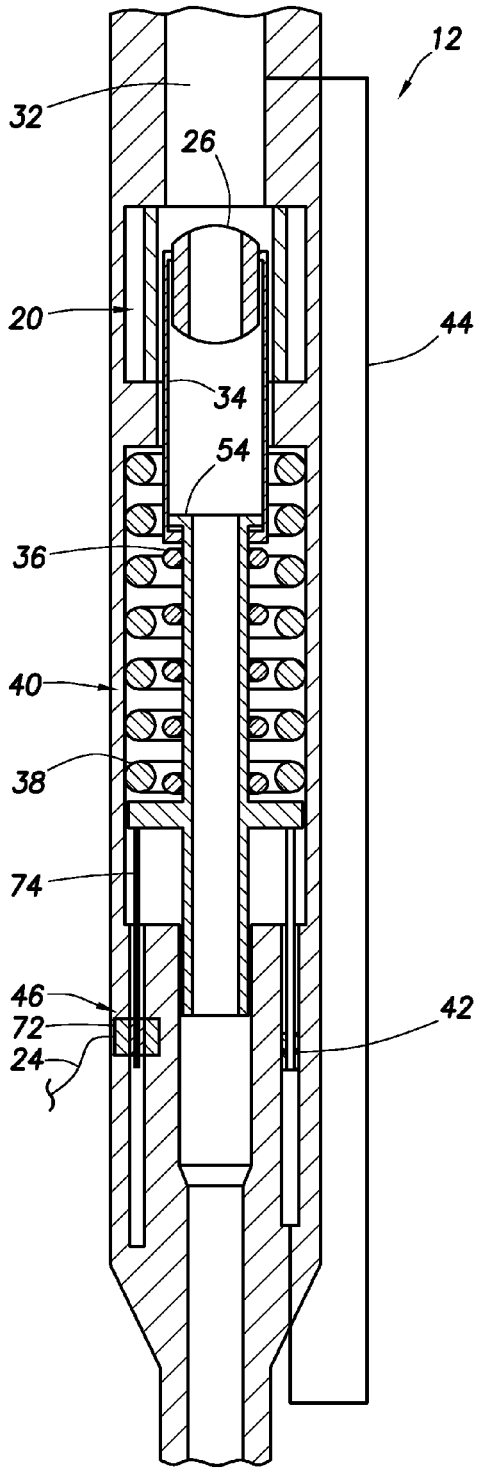

The closure device 26 is depicted in a closed position in FIG. 7A, and is depicted in an open position in FIG. 7B. Note that the components of the valve 12 as depicted in FIGS. 7A & B are "upside down" as compared to those of the other configurations of the valve described above.

The valve 12 of FIGS. 7A & B is of the type known to those skilled in the art as a fluid loss control valve, in that closing of the valve can be used to prevent the loss of fluid to a formation intersected by the wellbore 16. The valve 12 of FIGS. 7A & B could also be considered an isolation valve since, when the closure device 26 is closed, fluid flow in both directions is prevented through the flow passage 32.

Operation of the valve 12 of FIGS. 7A & B is very similar to that of the other configurations described above, except that the piston 42 is on its lower end exposed to pressure in the flow passage 32 above the closure device 26, and the piston is on its upper end exposed to pressure in the flow passage below the closure device. Thus, when the closure device 26 is in its closed position as depicted in FIG. 7A, and a pressure differential is created from above to below the closure device, the piston 42 is displaced upward to thereby store energy in the biasing devices 36, 38.

When sufficient energy has been stored in the biasing devices 36, 38, the gripper 72 is energized, thereby preventing the opening prong assembly 54 from displacing downward. When the gripper 72 is de-energized, the closure device 26 rotates to its open position in response to upward displacement of the member 34.

The valve 12 configuration of FIGS. 7A & B may be provided with the control system 76 and sensor 78, for example, to detect the presence of a structure (such as a tubular string, well tool, etc.) in the flow passage 32. In this manner, the valve 12 can be opened when the structure passes downwardly through the flow passage 32 to the valve, and the valve can be closed when the structure passes upwardly through the valve.

It may now be fully appreciated that the above disclosure provides several advancements to the art of constructing valves for downhole use. In examples described above, operation of the valve 12 is conveniently and reliably accomplished, without large electrical power requirements. In addition, examples described above can operate autonomously (e.g., using battery power or power generated downhole, using a sensor to detect when the valve is to be actuated, etc.).

The above disclosure provides to the art a method of actuating a valve 12 in a subterranean well. The method can include storing energy as a result of a differential pressure across a closed closure device 26 of the valve 12, and releasing at least a portion of the stored energy while opening the closure device 26.

The releasing step can be performed in response to interruption of a signal received by a control system 76 of the valve 12. The signal may comprise at least one of a hydraulic, mechanical, acoustic, pressure, electromagnetic, electric and optical signal. The signal may be transmitted from a remote location to a sensor 78 of the valve 12.

The storing energy step can include increasing a biasing force exerted by a biasing device 36 and/or 38 of the valve 12.

The storing energy step can include compressing a biasing device 36 and/or 38 with force generated by the pressure differential.

The releasing step may be performed in response to reducing the pressure differential across the closure device 26.

Also provided by the above disclosure is a valve 12 for use in a subterranean well. The valve 12 can include a closure device 26, a biasing device 36 and/or 38, and an actuator 40 which stores energy in the biasing device 36 and/or 38 in response to a pressure differential across the closure device 26.

The actuator 40 may include a piston 42 which is exposed to pressure on one side of the closure device 26. The piston 42 may further be exposed to pressure on an opposite side of the closure device 26. The piston 42 may be exposed to pressure external to the valve 12.

The actuator 40 may increase a biasing force exerted by the biasing device 36 and/or 38 in response to the pressure differential across the closure device 26.

The valve 12 may include an energy releasing device 46 which releases at least a portion of the energy from the biasing device 36 and/or 38. The releasing device 46 may release the energy in response to interruption of at least one of a hydraulic, mechanical, acoustic, pressure, electromagnetic, electric and optical signal.

The valve 12 may also include a sensor 78. The releasing device 46 can release the energy in response to interruption of a signal received by the sensor 78.

A well system 10 is also provided by the above disclosure. The well system 10 can include a tubular string 14 and a valve 12 which controls fluid flow through the tubular string. The valve 12 may include a closure device 26 and an actuator 40 which actuates the valve at least partially in response to a pressure differential across the closure device.

The actuator 40 can store energy as a result of the differential pressure, and can release at least a portion of the stored energy when the closure device 26 is opened. The energy may be released in response to interruption of a signal received by a control system 76 of the valve 12.

The signal may comprises at least one of a hydraulic, mechanical, acoustic, pressure, electromagnetic, electric and optical signal. The signal can be transmitted from a remote location to a sensor 78 of the valve 12.

A biasing force exerted by a biasing device 36 and/or 38 of the valve 12 may increase in response to the pressure differential across the closure device 26. The biasing device 36 and/or 38 may be compressed with force generated by the pressure differential.

The closure device 26 may open in response to reducing the pressure differential across the closure device.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of actuating a valve in a subterranean well, the method comprising:

storing energy as a result of a differential pressure across a closed closure device of the valve; and releasing a first portion of the stored energy while opening the closure device, wherein the valve includes a member which displaces to move the closure device between open and closed positions, wherein the member exerts an opening force against the closure device during the storing energy step, and wherein the force is resisted by the differential pressure.

2. The method of claim 1, further comprising releasing a second portion of the stored energy while closing the closure device, wherein the second portion releasing step is performed in response to interruption of a signal received by a control system of the valve.

3. The method of claim 2, wherein the signal comprises at least one of a hydraulic, mechanical, acoustic, pressure, electromagnetic, electric and optical signal.

4. The method of claim 2, wherein the signal is transmitted from a remote location to a sensor of the valve.

5. The method of claim 1, wherein the storing energy step further comprises increasing a biasing force exerted by a biasing device of the valve.

6. The method of claim 1, wherein the storing energy step further comprises compressing a biasing device with force generated by the pressure differential.

7. The method of claim 1, wherein the first portion releasing step is performed in response to reducing the pressure differential across the closure device.

8. A valve for use in a subterranean well, the valve comprising:

a closure device;

a member which displaces to move the closure device between open and closed positions;

a tubular opening prong slidingly received within the member;

a first biasing device which biases the member to extend relative to the tubular opening prong; and a piston coupled to the tubular opening prong, wherein the piston stores energy in the first biasing device in response to a pressure differential across the closure device, and wherein the first biasing device causes the member to extend when the pressure differential is reduced, thereby opening the valve.

9. The valve of claim 8, wherein the piston is exposed to pressure on a first side of the closure device.

10. The valve of claim 9, wherein the piston is further exposed to pressure on a second side of the closure device opposite to the first side.

11. The valve of claim 9, wherein the piston is further exposed to pressure external to the valve.

12. The valve of claim 8, wherein the piston increases a biasing force exerted by the first biasing device in response to the pressure differential across the closure device.

13. The valve of claim 8, further comprising an energy releasing device which releases energy from a second biasing device, thereby closing the valve.

14. The valve of claim 13, wherein the releasing device releases the energy in response to interruption of at least one of a hydraulic, mechanical, acoustic, pressure, electromagnetic, electric and optical signal.

15. The valve of claim 13, further comprising a sensor, and wherein the releasing device releases the energy in response to interruption of a signal received by the sensor.

16. The valve of claim 8, wherein the piston is coupled to the tubular opening prong via a magnetic coupling.

* * * * *